United States Patent [19]

Spooner

[11] Patent Number: 4,752,659

[45] Date of Patent: Jun. 21, 1988

[54] ARC INTERRUPTER

[75] Inventor: James Spooner, Sunderland, England

[73] Assignee: Northern Engineering Industries PLC, New Castle upon Tyne, England

[21] Appl. No.: 20,102

[22] Filed: Feb. 27, 1987

[30] Foreign Application Priority Data

Mar. 25, 1986 [GB] United Kingdom ..... 8607397

[51] Int. Cl.[4] ..... H01H 33/12

[52] U.S. Cl. ..... 200/146 R; 200/147 R

[58] Field of Search ..... 200/146, 147

[56] References Cited

U.S. PATENT DOCUMENTS

| | | | |
|---|---|---|---|
| 3,824,359 | 7/1974 | Date | 200/146 R |
| 3,825,708 | 7/1974 | Bergman | 200/146 R |
| 4,289,941 | 9/1981 | Cannon | 200/146 R |
| 4,355,220 | 10/1982 | Parry | 200/147 R |
| 4,521,654 | 6/1985 | Eberhardt et al. | 200/146 R |

*Primary Examiner*—Robert S. Macon

*Attorney, Agent, or Firm*—Rosen, Dainow & Jacobs

[57] ABSTRACT

The rating of an arc interrupter is improved by having a movable contact assembly, which is engageable with and completely disengageable from a fixed contact in make and break positions, respectively, consisting of two main current carrying members the first of which is the last part of the assembly to disengage from the fixed contact during an opening operation. The delay in disengaging the first contact member from the fixed contact can be achieved in several ways. For example, the geometry of the first contact member can be different from the geometry of the second contact member (by the provision of an arcing tip); by the provision of a lost-motion mechanism; or by the provision of an auxiliary contact.

25 Claims, 3 Drawing Sheets

ARC INTERRUPTER

BACKGROUND TO THE INVENTION

The invention relates to arc interrupters, particularly, though not exclusively, to arc interrupters in which the arc is rotated about an axis to assist in extinguishment of the arc.

An example of an arc interrupter of the type in which the arc is rotated about an axis is described and claimed in UK Pat. No. 2119573B. As discussed in U.S. Pat. No. 2119573B, the current ratings of an interrupter can be improved in various ways, for example by altering the size of components or by increasing the number of contact faces.

SUMMARY OF THE INVENTION

According to the present invention, an arc interrupter comprises a fixed contact and a movable contact assembly which, in a make position, is in engagement with said fixed contact whereby said assembly is included in an openable main current path and which, in a break position, is completely disengaged from said fixed contact, said movable contact assembly comprising at least first and second main current carrying contact members mounted for angular movement about respective pivot axes between said make and said break positions, said first contact member, during opening of said main current path, being the last part of said movable contact assembly to disengage from said fixed contact.

According to a preferred embodiment of the present invention, an arc interrupter comprises a fixed contact and a fixed electrode which provide, respectively, first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, and a movable contact assembly which, in a make position, is in engagement with said fixed contact whereby said assembly is included in an openable main current path and which, in a break position, is completely disengaged from said fixed contact and the least distance between said fixed contact and said openable contact assembly is greater than said gap, said coil being included in series with said arcing surfaces in an arc current path during a later part of movement of said movable contact assembly during opening of said main current path, said movable contact assembly comprising at least first and second main current carrying contact members mounted for angular movement about respective pivot axes between said make and said break positions, said first contact member during opening of said main current path, being the last part of said movable contact assembly to disengage from said fixed contact.

Preferably, said contact members are connected to a common drive member which is operable to move said contact member between said make and break positions.

Preferably, said respective pivot axes are separate and parallel to one another. Alternatively, the respective pivot axes are comprised by a common pivot axis.

Preferably, said contact members are mounted relative to said fixed contact such that they are movable in opposite directions to one another.

Preferably, said contact members are movable simultaneously with one another at least during said opening of said main current path, said first contact member having a shape adapted to ensure that said first contact is the last part of said movable contact assembly to disengage from said fixed contact.

Alternatively, during said opening of said main current path, the movement of said first contact member lags behind the movement of said second contact member. In that instance, preferably a lost motion mechanism connects said first contact member to the common drive member.

In a further alternative, preferably said first contact member has pivotally mounted thereon an auxiliary arcing contact, said auxiliary arcing contact being resiliently biased towards said fixed contact.

The invention includes an electric switch comprising at least one arc interrupter according to the invention.

BRIEF DESCRIPTION OF THE DRAWINGS

Electric switches will now be described to illustrate the invention by way of example only with reference to the accompanying drawings, in which.

DESCRIPTION OF THE PREFERRED EMBODIMENTS

Figure 1:
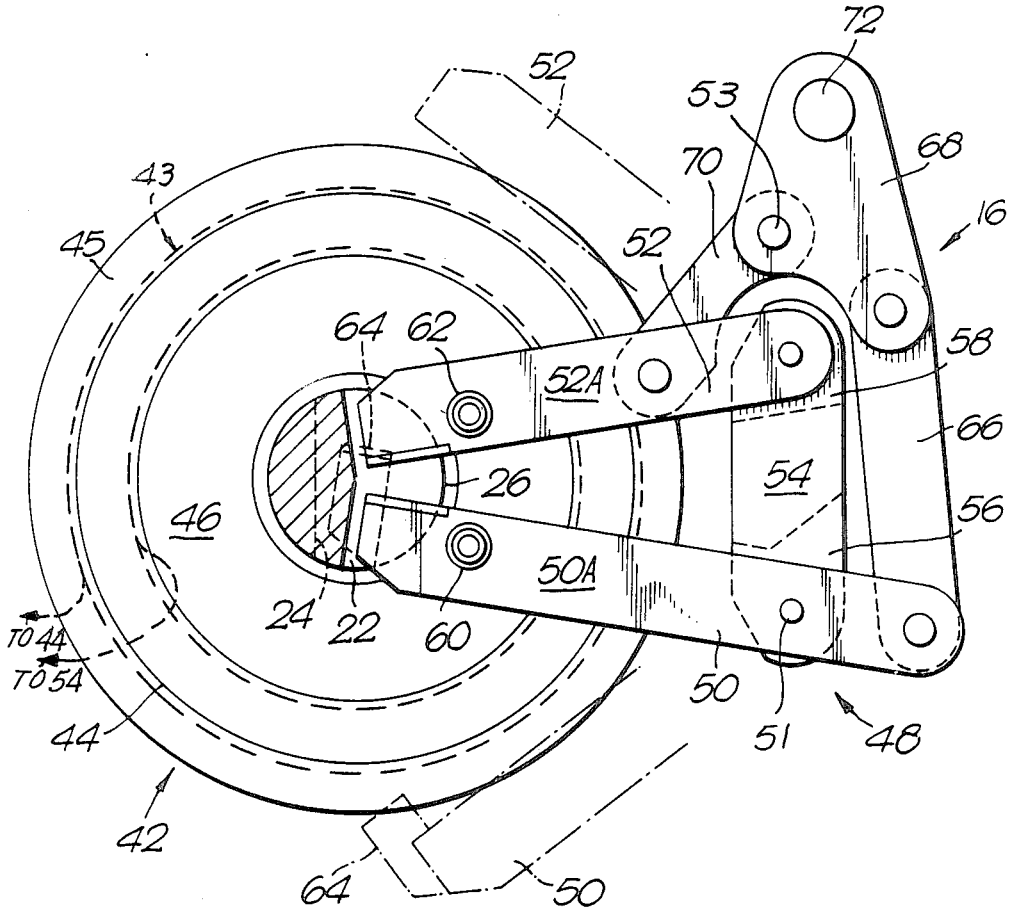
FIG. 1 is a section on line I—I in FIG. 2, showing, in part, an arc interrupter according to the invention.

The electric switch (see FIGS. 1 and 2) is of the type described and claimed in UK Pat. No. 2119573B and reference should be made to that document for details concerning the construction of such switches.

Briefly, however, the switch has a housing 10 of metal for example defining an enclosure which is filled with an insulating medium 11 for example sulphur hexafluoride ($SF_6$) gas under pressure. A bushing 12 insulates a main copper conductor 14 from, and enables it to pass in sealed relationship, through the housing 10. A second main conductor (not shown) is similarly mounted relative to the housing 10 at a location remote from the conductor 14. The two main conductors carry one phase of the current supplied through the switch.

An arc interrupter 16 forms part of an openable main current path between the two main conductors. The conductor 14 and the interrupter 16 are coaxial with one another on the common axis 18.

The interrupter 16 has a fixed contact 20 formed on the end of the conductor 14 coaxially with the axis 18. Two segments have been removed from one side of the fixed contact 20 to form slots 22, 24 on either side of a contact tongue 26 which is engageable by contact members 50, 52 (described more fully below). The lower end of the fixed contact 20 is formed by an arcing member 30 mounted on a lower flange 28, the member 30 having an arcing tip 32 of arc-resistant material such as Elkonite (registered trade mark). The arcing tip 32 is engageable with an arcing tip 64 on the end of the contact member 50 whereby, upoon opening of the main current path, an arc is struck initially between the tips 32, 64.

A bore 34, which is stepped in diameter to form a shoulder, extends through the end of the arcing member 30. A flanged pin 36 is located in the bore 34 and is screwed into the end 28 of the contact 20. The flange of the pin 36 engages with a spring 38 located in the bore 34 to retain the member 30 relative to the fixed contact 20.

The arcing member 30 provides a first arcing surface 40 coaxial with the axis 18. Once the arc has been struck between the two arcing tips 32, 64, the arc readily transfers to the surface 40 and rotates around the surface 40 as is more fully described below.

A fixed assembly 42 is secured to the housing 10 through insulated mounts (not shown). The assembly 42 comprises a cylindrical arcing electrode 44 of copper which mounted coaxially with the axis 18 and is surrounded by, and is electrically connected to one end of, an arc-driving coil 4 (shown in ghost outline in FIG. 1). The other end of the coil is electrically connected to the second main conductor. To enhance the effect of the coil on the arc, ferromagnetic material 45 such as mild steel is located around the coil.

The electrode 44 has an internal surface which forms a second arcing surface 46 coaxial with the axis 18 and spaced from and positioned substantially opposite to the arcing surface 40 of the fixed contact 20 so that an annular gap exists between the arcing surfaces 40 and 46.

A movable contact assembly 48 is located adjacent to the electrode 44.

The assembly 48 has first and second movable contact members 50, 52 mounted on a pivot block 54 and having pivot axes 51 and 53, respectively for angular movement between a make position (shown in full outline in FIG. 1) in which the members 50, 52 engage with the fixed electrode 20 and a break position (shown in ghost outline in FIG. 1) in which the least distance between the members 50, 52 and the fixed contact 20 is greater than the gap between the arcing surfaces 40, 46.

Each contact member 50, 52 consists of two plates 50A, 50B and 52A, 52B respectively, which lie on either side of respective wings 56, 58 extending from the pivot block 54. To ensure the members 50, 52 positively engage the contact tongue 26 of the fixed contact 20, spring assemblies 60, 62 (similar to the pin and spring arrangement 36, 38 at the end of the fixed contact 20) resiliently urge the plates 50A, 50B and 52A, 52B of each pair towards one another.

The plates 50A, 50B and 52A, 52B are chamfered at the ends thereof which engage the contact tongue 26.

The plate 50B of the contact member 50 has an arcing tip 64 molded on its end, which arcing tip 64 is in engagement with the arcing tip 32 on the fixed contact 20 in the make position of the interrupter. The arcing tip 64 extends beyond the extremity of the plate 50B. The arcing tip 64 is made of an arc-resistant material such as Elkonite (registered trade mark).

The pivot block 54 is electrically connected to the second main conductor.

The contact member 50 extends beyond the pivot block 54 to engage pivotally, between the plates 52A, 52B thereof, one end of a link 66. The other end of the link 66 is pivotally attached to one limp of a crank 68. The other limp of the crank 68 is pivotally attached to one end of a second link 70 the other end of which is pivotally connected to the contact member 52 between the plates 52A, 52B thereof.

The crank 68 is mounted on a drive shaft 72 for reciprocable rotation therewith whereby the contact members are moved by the crank 68 and the links 66, 70 between their respective make and break positions.

OPERATION

The interrupter 16 is shown in the make position. The main current path is through the main conductor 14, the fixed contact 20, the movable contact members 50, 52, the pivot block 54 and the second main conductor.

Actuation of an operating mechanism (not shown) turns the drive shaft 72. Consequently, the crank 68 turns and, through the links 66, 70 simultaneously pulls the contact members 50, 52 to the positions shown in ghost outline.

During the angular opening movement of the contact members 50, 52 about their respective pivot axes, the plates 50A, 50B and 52A, 52B, respectively, substantially simultaneously disengage from the contact tongue 26 of the fixed contact 20. However, no arc is struck between the plates 50A, 50B and 52A, 52B and the fixed contact 20 since the arcing tip 64, which forms part of the contact member 50, has not disengaged from the arcing tip 32 on the fixed contact 20, i.e. it is the last part of the movable contact assembly 48 to disengage from the fixed contact.

As the opening movement continues, the arcing tips 32 and 64 separate and an arc is struck between them. The contact members 50, 52 rapidly move to their break positions and, as the arcing tip 64 passes over the electrode 44, the arc is transferred to the electrode 44 which brings the arc-driving coil into an arc current path. The magnetic field generated by the coil causes the arc to rotate about the axis 18, the root of the arc on the fixed contact 20 rapidly transferring from the arcing tip 32 to the first arcing surface 40.

At an appropriate current zero the arc is extinguished.

The interrupter 16 is closed by reverse operation of the operating mechanism which causes the contact members 50, 52 to return to their make positions.

The switch described with reference to FIGS. 1 and 2 has a normal rating of 12 kilovolts (KV), 1.25 kiloamperes (kA) and a fault-condition rating of 25 kA.

The use of contact members 50, 52 having multiple contact interfaces, increased contact pressure and an increase in the amount of copper available to carry large currents as compared to conventional contacts enables a switch having an increased rating to be designed. Furthermore, by ensuring the arc is struck between the first contact member and the fixed contact, the unwanted affects of spurious arcing on other components can be avoided.

Typically, switches having interrupters in accordance with the invention can have normal ratings of up to 36 kV, 2 kA and fault condition ratings of up to 40 kA.

If desired, during maintenance checks, the amount of errosion to which the arcing tips 32 and 64 have been subjected can be checked as described below.

When the tips 32, 64 are new, with the main current off, a battery is attached across the main conductors and the interrupter is slowly closed until the battery potential is registered on a voltmeter, for example. A registration mark is then made on the operating mechanism.

The procedure is then repeated during maintenance checks until the difference between the current "just closed" position and the original registration position indicates that the errosion is sufficient to warrant replacement of the tips. The procedure also provides a check that one or other of the tips has not fallen off.

Figure 2:
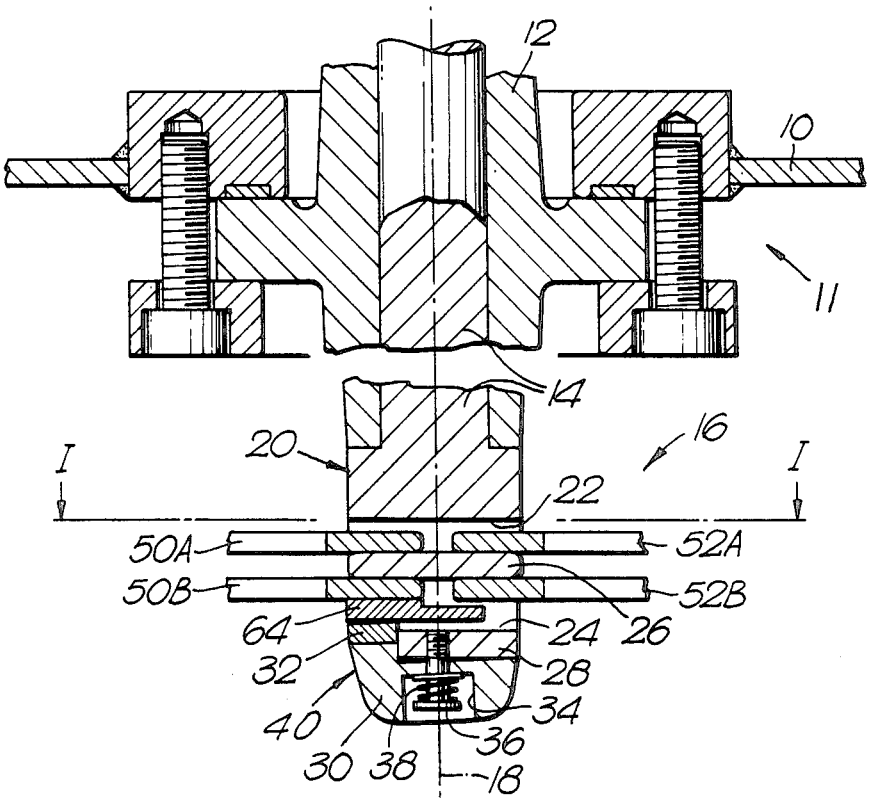
FIG. 2 is a longitudinal section through the fixed contact of the interrupter shown in FIG. 1, the position of the movable contact members in the make position being indicated schematically.
Figure 3:
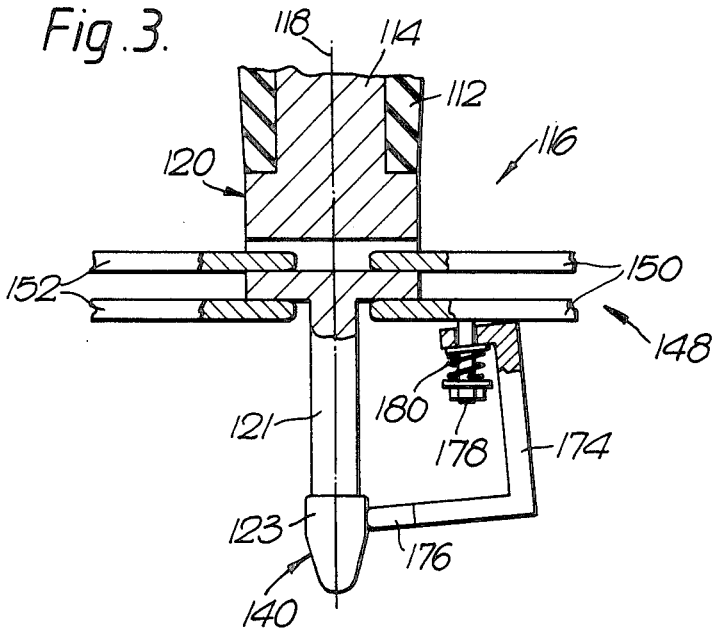
FIGS. 3 and 4 are longitudinal sections through a fixed contact for a second and a third form of arc interrupter according to the invention, the position of the movable contact members being indicated schematically.

In the embodiment shown in FIG. 3, the interrupter 116 is similar to that shown in FIGS. 1 and 2, like parts having the same reference numerals as used in FIGS. 1 and 2 but with the prefix "1". However, the lower end of the fixed contact 120 is an elongate cylindrical stub 121 of relatively small diameter which has a tip 123 of arc-resistant material. The surface of the stub 121 forms a first arcing surface 140 which is contacted by a tip 176 of arc-resistant material of an auxiliary arcing contact 174 carried by and forming part of the first contact member 150.

The auxiliary arcing contact 174 is resiliently mounted on the member 150 by a pin-and-spring arrangement 178, 180. In the make position shown in FIG. 3, the arcing tips 123 and 176 are in engagement and the contact 174 has been pivoted relative to the member 150 against the bias of the spring 180. During opening of the interrupter 116, the spring 180 causes the tip 176 of the contact 174 to remain in engagement with the tip 123 until after the members 150, 152 have disengaged from the fixed contact 120, i.e. the contact 174 is the last part of the contact member 150 to disengage from the fixed contact 120.

Figure 4:
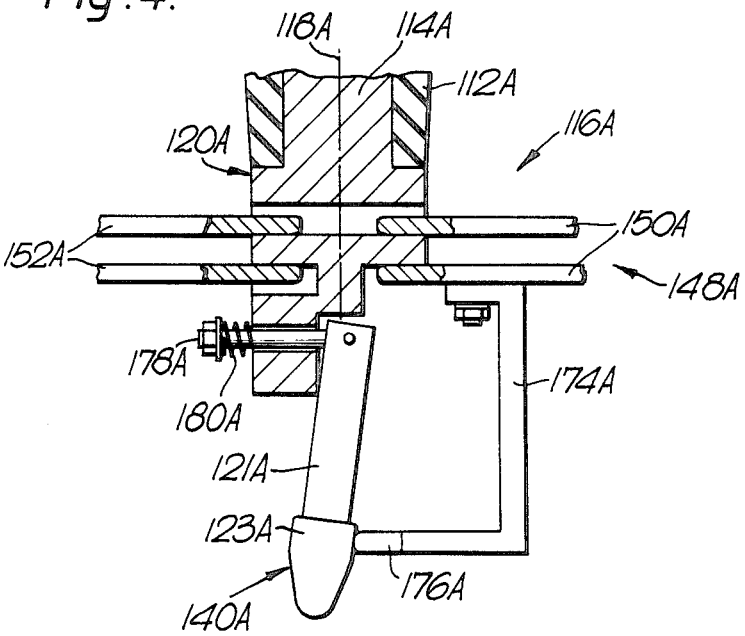

A similar interrupter 116A is shown in FIG. 4, but in this instance the stub 121A of the fixed contact 120A is mounted by means of a pin-and-spring arrangement 178A, 180A on the remainder of the fixed contact 120A. In the make position, as shown in FIG. 4, the stub 121A has been pivoted out of alignment with the axis 118A against the bias of the spring 180A by the auxiliary arcing contact 174A. During opening of the interrupter 116A, the spring 180A causes the stub 121A to pivot back into alignment with the axis 118A and to remain in contact with the contact 174A until the members 150A, 152A have disengaged from the fixed contact 120A.

The relatively small diameter of the cylindrical stub 121, 121A of the fixed contact 120, 120A allows the diameter of the fixed electrode (not shown) to be reduced also without decreasing the gap between the arcing surfaces. Such reductions in size lead to savings in both materials and space. Additionally, a shield of insulating material can be interposed between the main current-carrying contact members and the arcing contact member.

Other modifications are possible within the scope of the invention. For example, more than two contact members may be used for carrying the normal current; the contact members may be driven separately; the contact members may have a common pivot axis; the movement of the first contact member may lag behind the movement of the second contact member, in which instance a lost-motion mechanism connects the first member to the drive shaft and the first contact member can be made of arc-resistant material.

Although the invention has been described with particular reference to interrupters of the type in which the arc is rotated about an axis, it is to be understood that the invention is applicable to other types of interrupter also. For example, in interrupters of the type having an arc chute, the first contact member is used to draw the arc into the arc chute which aids in extinguishing the arc at an appropriate current zero.

I claim:

1. An arc interrupter comprising a fixed contact and a movable contact assembly which, in a make position, is in engagement with said fixed contact whereby said assembly is included in an openable main current path and which, in a break position, is completely disengaged from said fixed contact, said movable contact assembly comprising at least first and second main current carrying contact members mounted for angular movement in opposite directions to one another about respective pivot axes between said make and said break position, said first contact member, during opening of said main current path, being the last part of said movable contact assembly to disengage from said fixed contact.

2. An arc interrupter comprising a fixed contact and a fixed electrode which provide, respectively first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, and a movable contact assembly which, in a make position, is in engagement with said fixed contact whereby said assembly is included in an openable main current path and which, in a break position, is completely disengaged from said fixed contact and the least distance between said fixed contact and said movable contact assembly is greater than said gap, said coil being included in series with said arcing surfaces in an arc current path during a later part of movement of said movable contact assembly during opening of said main current path, said movable contact assembly comprising at least first and second main current carrying contact members mounted for angular movement about respective pivot axes between said make and said break positions, said first contact member, during opening of said main current path, being the last part of said movable contact assembly to disengage from said fixed contact.

3. An interrupter according to claim 2, in which said contact members are connected to a common drive member which is operable to move said contact members between said make and break positions.

4. An interrupter according to claim 2, in which said respective pivot axes are separate and parallel to one another.

5. An interrupter according to claim 2, in which said respective pivot axes are comprised by a common pivot axis.

6. An interrupter according to claim 2, in which said respective pivot axes are parallel to said common axis.

7. An interrupter according to claim 2, in which said contact members are normal to said respective pivot axes.

8. An interrupter according to claim 2, in which said contact members are mounted relative to said fixed contact such that they are movable in opposite directions to one another.

9. An interrupter according to claim 2, in which said contact members are movable simultaneously with one another at least during said opening of said main current path, said first contact member having a shape adapted to ensure that said first contact member is the last part of said movable contact assembly to disengage from said fixed contact.

10. An interrupter according to claim 2, in which during said opening of said main current path, the movement of said first contact member lags behind the movement of said second contact member.

11. An interrupter according to claim 2, in which a lost motion mechanism connects said first contact member to the common drive member.

12. An interrupter according to claim 2, in which said first contact member comprises an auxiliary arcing contact pivotally mounted thereon, said auxiliary arcing contact being resiliently biased towards said fixed contact whereby said auxiliary arcing contact is the last part of said first contact member to disengage from said fixed contact.

13. An interrupter according to claim 2, in which said first contact member comprises an auxiliary arcing contact mounted thereon and in which said fixed contact comprises a stub which is pivotally mounted thereon and resiliently biased towards a break position, and which, in said make position is engaged with, and pivoted away from the break position thereof by, said auxiliary arcing contact whereby said auxiliary arcing contact is the last part of said first contact member to disengage from said fixed contact.

14. An electric switch comprising a housing containing insulating medium and conductor means which form an openable main current path within the housing and which includes at least one arc interrupter comprising a fixed contact and a movable contact assembly which, in a make position, is in engagement with said fixed contact whereby said assembly is included in an operable main current path and which, in a break position, is completely disengaged from said fixed contact, said movable contact assembly comprising at least first and second main current carrying contact members mounted for angular movement about respective pivot axes between said make and said break positions, said first contact member, during opening of said main current path, being the last part of said movable contact assembly to disengage from said fixed contact.

15. An electric switch comprising a housing containing insulating medium and conductor means which form an openable main current path within the housing and which includes at least one arc interrupter comprising a fixed contact and a fixed electrode which provide, respectively first and second coaxial arcing surfaces separated by an annular gap, said first arcing surfaces being closer to the common axis of said arcing surfaces than said second arcing surface, an arc-driving coil coaxial with said arcing surfaces, said coil being electrically connected at one end to said electrode, and a movable contact assembly which, in a make position, is in engagement with said fixed contact whereby said assembly is included in an openable main current path and which, in a break position, is completely disengaged from said fixed contact and the least distance between said fixed contact and said movable contact assembly is greater than said gap, said coil being included in series with said arcing surfaces in an arc current path during a later part of movement of said movable contact assembly during opening of said main current path, said movable contact assembly comprising at least first and second main current carrying contact members mounted for angular movement about respective pivot axes between said make and said break positions, said first contact member, during opening of said main current path, being the last part of said movable contact assembly to disengage from said fixed contact.

16. An interrupter according to claim 1, in which said contact members are connected to a common drive member which is operable to move said contact members between said make and break positions.

17. An interrupter according to claim 1, in which said respective pivot axes are separate and parallel to one another.

18. An interrupter according to claim 1, in which said respective pivot axes are comprised by a common pivot axis.

19. An interrupter according to claim 1, in which said respective pivot axes are parallel to said common axis.

20. An interrupter according to claim 1, in which said contact members are normal to said respective pivot axes.

21. An interrupter according to claim 1, in which said contact members are movable simultaneously with one another at least during said opening of said main current path, said first contact member having a shape adapted to ensure that said first contact member is the last part of said movable contact assembly to disengage from said fixed contact.

22. An interrupter according to claim 1, in which during said opening of said main current path, the movement of said first contact member lags behind the movement of said second contact member.

23. An interrupter according to claim 1, in which a lost motion mechanism connects said first contact member to the common drive member.

24. An interrupter according to claim 1, in which said first contact member comprises an auxiliary arcing contact pivotally mounted thereon, said auxiliary arcing contact being resiliently biased towards said fixed contact whereby said auxiliary arcing contact is the last part of said first contact member to disengage from said fixed contact.

25. An interrupter according to claim 1, in which said first contact member comprises an auxiliary arcing contact mounted thereon and in which said fixed contact comprises a stub which is pivotally mounted thereon and resiliently biased towards a break position, and which, in said make position is engaged with, and pivoted away from the break position thereof by, said auxiliary arcing contact whereby said auxiliary arcing contact is the last part of said first contact member to disengage from said fixed contact.

* * * * *